US011480140B1

(12) United States Patent
Moore et al.

(10) Patent No.: US 11,480,140 B1
(45) Date of Patent: Oct. 25, 2022

(54) SELF-CALIBRATING ENGINE AIR FILTER LIFE MONITORING SYSTEM

(71) Applicant: GM GLOBAL TECHNOLOGY OPERATIONS LLC, Detroit, MI (US)

(72) Inventors: Joseph K. Moore, Whitby (CA); Lei Li, Whitby (CA); Chong Keong Tang, Markham (CA)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 17/304,249

(22) Filed: Jun. 17, 2021

(51) Int. Cl.
*F02M 35/09* (2006.01)
*F02M 35/10* (2006.01)
*F02D 41/18* (2006.01)

(52) U.S. Cl.
CPC ..... *F02M 35/09* (2013.01); *F02M 35/1038* (2013.01); *F02M 35/10386* (2013.01); *F02D 41/18* (2013.01)

(58) Field of Classification Search
CPC ..... F02M 35/09; F02M 35/1038; F02M 35/10386; F02D 41/18
See application file for complete search history.

(56) References Cited

U.S. PATENT DOCUMENTS 5,606,311 A * 2/1997 Polidan ..... B01D 46/0086 340/607
8,626,456 B2 1/2014 Moore et al.
10,006,393 B2 6/2018 Moore et al.
2005/0240338 A1* 10/2005 Ardisana ..... F02D 41/18 73/114.37
2008/0229720 A1* 9/2008 Benscoter ..... B01D 46/446 55/385.3
2013/0036804 A1* 2/2013 Uehara ..... B01D 46/0086 73/114.31
2017/0211498 A1* 7/2017 Moore ..... F02M 35/024
2018/0204393 A1* 7/2018 Landolsi ..... B60L 58/10
2019/0197794 A1* 6/2019 Carpenter ..... F02M 35/0208
2019/0390564 A1* 12/2019 Parsons ..... F01D 21/003

* cited by examiner

*Primary Examiner* — Phutthiwat Wongwian
*Assistant Examiner* — Anthony L Bacon
(74) *Attorney, Agent, or Firm* — Quinn IP Law

(57) ABSTRACT

A self-calibration method of determining remaining useful life of an internal combustion engine's air filter includes establishing a pressure drop versus mass airflow rate relationship for a clean air filter using pressure drop, mass airflow rate, and temperature data captured at low and elevated engine speeds. The method also includes establishing a maximum clean air filter pressure drop at a preset maximum airflow using the clean filter relationship. The method additionally includes establishing a pressure drop versus mass airflow rate relationship for an in-service air filter using pressure drop, mass airflow rate, and temperature data captured at low and elevated engine speeds. The method also includes determining a maximum in-service air filter pressure drop at the preset maximum airflow using the in-service filter relationship. The method further includes comparing the maximum clean and in-service air filter pressure drops to determine the remaining useful life of the in-service air filter.

20 Claims, 3 Drawing Sheets

FIG. 1
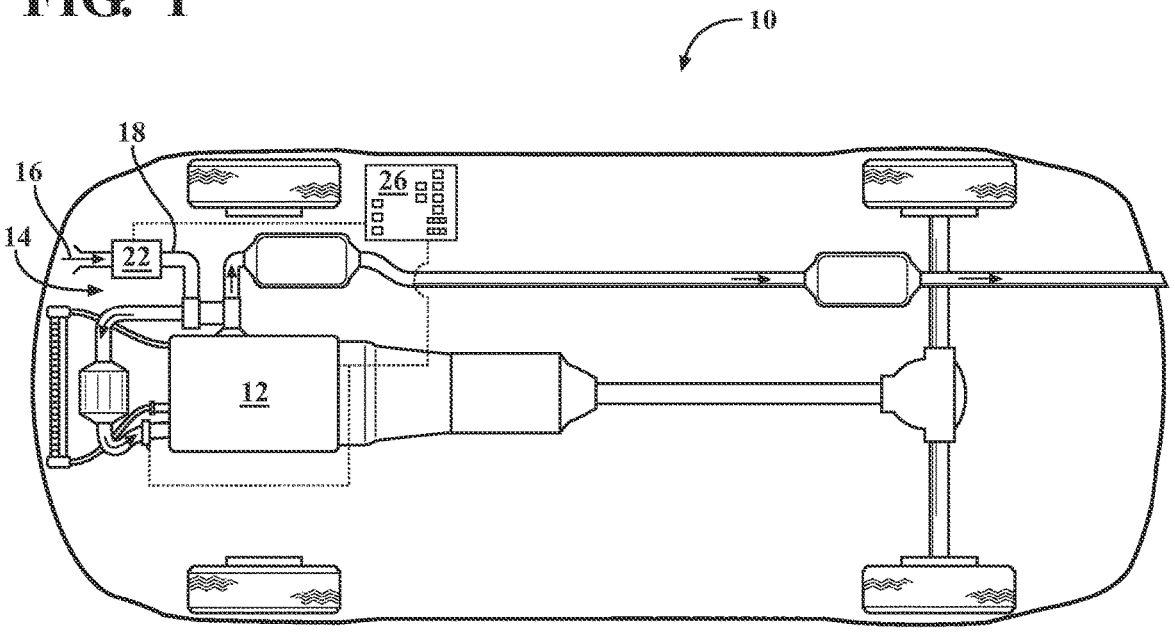
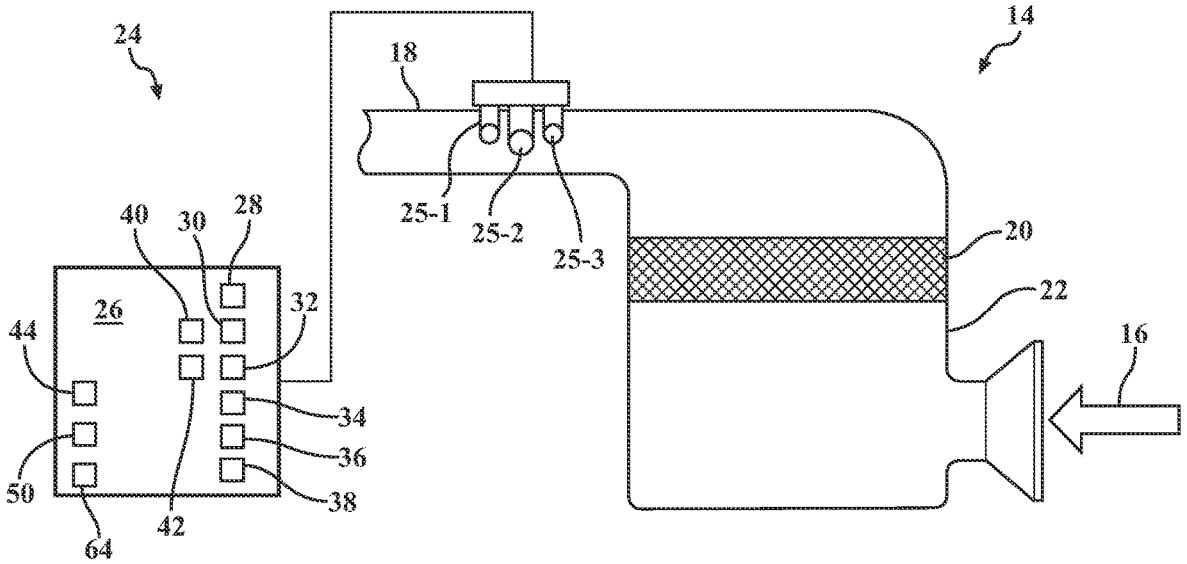
FIG. 2

SELF-CALIBRATING ENGINE AIR FILTER LIFE MONITORING SYSTEM

INTRODUCTION

The present disclosure relates to self-calibration of an internal combustion engine (ICE) air filter life monitoring system and determination of air filter useful life.

Air filters filter particulate matter out of an air stream. For example, air filters for an internal combustion engine filter particulate matter prior to introduction of the air into the combustion chamber. Over time the particulate matter accumulates and clogs the filter. A clogged air filter may lead to inefficient operation of the engine and should be replaced.

Such air filters have historically been monitored in an indirect manner to determine when they should be replaced. For example, the distance a vehicle was driven since its last air filter replacement is commonly used as a means for determining when it is time to replace the air filter. Using distance covered as a basis for making such a determination relies primarily on a correlation between the distance covered by the vehicle and the rate at which the vehicle's air filter clogs with particulates. Actual correlation between the distance covered by the vehicle and the degree of filter blockage, however, is widely influenced by factors such as the amount of particulates in the environment in which the vehicle sees operation. The concentration of particulates may be several orders of magnitude higher in arid and semi-arid regions.

Accordingly, the method of determining when to replace a vehicle's air filter based on the distance covered by the vehicle may be imprecise. Consequently, it is desirable to provide methods and systems for determining a remaining useful life of an air filter based on factors more representative of the degree of filter blockage. Various methods have been developed to determine the useful life of an air filter. However, these methods frequently require costly calibration testing to generate calibration relationships for each vehicle engine combination.

SUMMARY

A method of self-calibration of an internal combustion engine (ICE) air filter life monitoring system regulated by an electronic controller includes acquiring, at a low ICE speed, a first clean air filter data set defined by a first clean air filter pressure, a first clean air filter mass airflow rate, and a first clean air filter temperature. The first clean air filter data set is acquired by regulating and interrogating respective ICE sensors via the electronic controller. The method also includes acquiring, at an elevated ICE speed, a second clean air filter data set defined by a second clean air filter pressure, a second clean air filter mass airflow rate, and a second clean air filter temperature. The second clean air filter data set is acquired by regulating and interrogating the respective ICE sensors via the electronic controller. The method additionally includes establishing, via the electronic controller, a clean air filter pressure drop vs. mass airflow rate relationship using the acquired clean air filter first and second data sets. The method also includes determining a maximum clean air filter pressure drop at a preset maximum mass airflow rate with the clean air filter using the clean air filter relationship.

The method additionally includes acquiring, at the low ICE speed, a first in-service air filter data set defined by a first in-service air filter pressure, a first in-service air filter mass airflow rate, and a first in-service air filter temperature.

The first in-service air filter data set is acquired by regulating and interrogating the respective ICE sensors via the electronic controller. The method also includes acquiring, at the elevated ICE speed, a second in-service air filter data set defined by a second in-service air filter pressure, a second in-service air filter mass airflow rate, and a second in-service air filter temperature. The second in-service air filter data set is acquired by regulating and interrogating the respective ICE sensors via the electronic controller. The method additionally includes establishing, via the electronic controller, an in-service air filter pressure drop vs. mass airflow rate relationship using the acquired in-service air filter first and second data sets. The method also includes determining a maximum in-service air filter pressure drop at the preset maximum mass airflow rate with the in-service air filter using the in-service air filter relationship.

The method additionally includes comparing, via the electronic controller, the maximum air filter pressure drop for the in-service air filter with the maximum pressure drop for the clean air filter to compute an in-service vs. clean air filter pressure drop difference at the preset maximum mass airflow rate. Furthermore, the method includes determining and storing, via the electronic controller, the remaining useful life of the in-service air filter corresponding to the computed pressure drop difference.

The method may also include determining an atmospheric air pressure downstream of the clean air filter with the ICE off. In the same embodiment, the method may further include determining a clean air filter pressure at the low ICE speed, and also determining a clean air filter pressure drop via computing a difference between the determined atmospheric air pressure downstream of the clean air filter with the ICE off and the determined clean air filter pressure at the low ICE speed. The clean air filter pressure drop may be corrected to a reference temperature and pressure. Establishing the clean air filter relationship may additionally include using the determined clean air filter pressure drop at the first clean air filter mass airflow rate.

Establishing the clean air filter relationship may be accomplished in two stages. Establishing the clean air filter subject relationship may specifically include establishing a coarse clean air filter relationship in a first stage using the acquired clean air filter first and second data sets and the clean air filter pressure drop to estimate the second clean air filter pressure drop at the second clean air filter mass airflow rate. Establishing the subject relationship may also include generating a first quadratic equation to fit the second clean air filter pressure drop and the second clean air filter mass airflow rate with the coarse clean air filter relationship. Additionally, establishing the subject relationship may include establishing a final clean air filter relationship in a second stage using new first and second data sets and the first quadratic equation to estimate a final second clean air filter pressure drop at a final second clean air filter mass airflow rate. Establishing the clean air filter relationship may furthermore include generating a second quadratic equation to fit the final second clean air filter pressure drop and the final second clean air filter mass airflow rate with the final clean air filter relationship.

Establishing the coarse and the final clean air filter relationships may include collecting multiple data pairs to refine the clean air filter pressure drop vs. mass airflow rate relationship. Establishing the coarse and the final clean air filter relationships may also include organizing the collected multiple data pairs in a predetermined number of bins. Establishing the coarse and the final clean air filter relationships may additionally include averaging the data pairs in each respective bin. Establishing the coarse and the final clean air filter relationships may further include using the averaged data pairs of the clean air filter to generate each of the first quadratic equation for the coarse clean air filter relationship and the second quadratic equation for the final clean air filter relationship.

Generating the second quadratic equation may include determining polynomial coefficients of the second quadratic equation. Additionally, determining the maximum air filter pressure drop with the clean air filter may include using the final clean air filter relationship.

The method may additionally include determining an atmospheric air pressure downstream of the in-service air filter with the ICE off and determining an in-service air filter pressure at the low ICE speed. The method may additionally include determining an in-service air filter pressure drop via computing a difference between the determined atmospheric air pressure downstream of the in-service air filter with the ICE off and the determined in-service air filter pressure at the low ICE speed. The in-service air filter pressure drop may be corrected to the reference temperature and pressure. Furthermore, establishing the in-service air filter relationship may additionally include using the determined in-service air filter pressure drop at the first in-service air filter mass airflow rate.

Establishing the in-service air filter relationship may be accomplished in two stages. Establishing the subject in-service air filter relationship may include establishing a coarse in-service air filter relationship in a first stage using the acquired in-service air filter first and second data sets and the in-service air filter pressure drop to estimate the second in-service air filter pressure drop at the second in-service air filter mass airflow rate. Establishing the subject relationship may also include generating a first quadratic equation to fit the second in-service air filter pressure drop and the second in-service air filter mass airflow rate with the coarse in-service air filter relationship. Establishing the subject relationship may additionally include establishing a final in-service air filter relationship in a second stage using new first and second in-service air filter data sets and the first quadratic equation to estimate a new second in-service air filter pressure drop at the second in-service air filter mass airflow rate. Establishing the subject in-service air filter relationship may furthermore include generating a second quadratic equation to fit the new second in-service air filter pressure drop and the second in-service air filter mass airflow rate with the final in-service air filter relationship.

Establishing the coarse and final in-service air filter relationships may include collecting multiple data pairs to refine the in-service air filter pressure drop vs. mass airflow rate relationship. Establishing the coarse and final in-service air filter relationship may also include organizing the collected multiple data pairs in a predetermined number of bins and averaging the data pairs in each respective bin. Establishing the coarse and final in-service air filter relationship may further include using the averaged data pairs of the in-service air filter to generate each of the first quadratic equation for the coarse in-service air filter relationship and the second quadratic equation for the final in-service air filter relationship.

According to the method, generating the second quadratic equation may include determining polynomial coefficients of the second quadratic equation. Additionally, according to the method, determining the maximum air filter pressure drop with the in-service air filter may include using the final in-service air filter relationship.

The method may additionally include setting a sensory signal when the computed pressure drop difference is equal to or greater than a predetermined value. The predetermined value may be in a range of 2.3-2.5 kPa.

Another embodiment of the disclosure is directed to a self-calibrating air filter life monitoring system for an internal combustion engine (ICE). The air filter life monitoring system includes an air induction system having an air filter in fluid communication with an ICE. The air filter life monitoring system additionally includes an electronic controller configured to determine remaining useful life of the air filter according to the above-described method.

A further embodiment of the disclosure is directed to a non-transitory computer-readable medium having executable instructions stored thereon for self-calibration of an internal combustion engine (ICE) air filter life monitoring system.

The above features and advantages, and other features and advantages of the present disclosure, will be readily apparent from the following detailed description of the embodiment(s) and best mode(s) for carrying out the described invention when taken in connection with the accompanying drawings and appended claims.

BRIEF DESCRIPTION OF THE DRAWINGS

FIG. 1 is a schematic illustration of a vehicle including an internal combustion engine using an induction system with an air filter and employing a self-calibrating air filter life monitoring system regulated by an electronic controller, according to the disclosure.

FIG. 2 is a schematic close-up partial side view of the induction system and the air filter shown in FIG. 1, illustrating arrangement of pressure, temperature, and mass airflow rate sensors in communication with the electronic controller.

DETAILED DESCRIPTION

Figure 3:
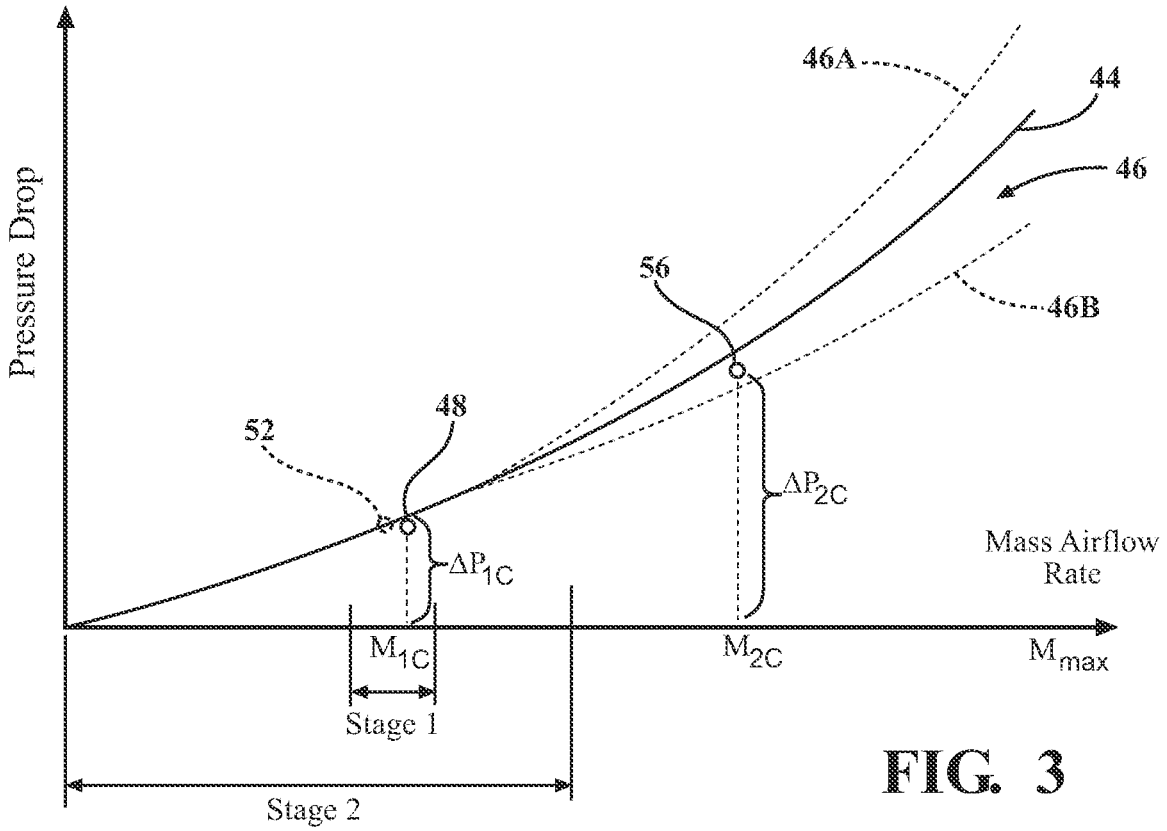
FIG. 3 is a graph of pressure drop versus mass airflow rate, illustrating two-stage development of a clean air filter relationship and an in-use air filter relationship via the air filter life monitoring system, according to the disclosure.

Referring to the drawings wherein like reference numbers correspond to like or similar components throughout the several figures, FIG. 1 illustrates a vehicle 10 having an internal combustion engine (ICE) 12. As shown in FIG. 1, the ICE 12 includes an induction system 14 configured to channel an airflow 16 from the ambient to the engine's combustion chambers (not shown). The induction system 14 includes an air inlet duct 18 in fluid communication with the ICE 12, shown in FIGS. 1 and 2. The induction system 14 additionally includes an air filter 20, typically housed inside an air cleaner housing 22 (shown in FIGS. 1 and 2), upstream of the combustion chambers for removing particulate matter, e.g., foreign particles and other airborne debris, from the airflow 16. The air inlet duct 18 is configured to channel the airflow 16 from the ambient to the combustion chambers, such as via an intake manifold (not shown). The intake manifold in turn distributes the airflow 16 to the combustion chambers for mixing with an appropriate amount of fuel and subsequent combustion of the resultant fuel-air mixture.

Generally, an air filter, such as the air filter 20, when in its new or clean state permits induction air to pass through without a significant pressure differential or drop (ΔP) between an upstream side and a downstream side of the air filter. Thus, a clean air filter may remove particulate matter from the airstream without generating a significant restriction in the air duct and choking off the engine's air supply. As the air filter becomes clogged with particulate matter, the pressure drop increases to a point where the restriction begins to adversely impact efficiency of the engine, the filter is considered to have reached the end of its useful life and is recommended to be replaced. Pressure differentials across new and end-of-life air filters may be determined empirically, such as during laboratory testing, over a desired range of mass airflow rates for a particular engine. Actual pressure and mass airflow rates may be determined or measured via respective sensors positioned within the respective induction system and in communication with an electronic data processor.

With reference to FIG. 2, the vehicle 10 also includes a self-calibrating air filter life monitoring system 24. The air filter life monitoring system 24 includes the induction system 14, as well as a mass airflow rate sensor 25-1, a pressure sensor 25-2, and an air temperature sensor 25-3 positioned therein. The air filter life monitoring system 24 further includes an electronic controller 26 in communication with the mass airflow rate sensor 25-1, the pressure sensor 25-2, and the air temperature sensor 25-3. The electronic controller 26 is in operative communication with the ICE 12. The electronic controller 26 may be a central processing unit (CPU) configured to regulate various functions on the vehicle 10 or a dedicated electronic control unit (ECU) having a microprocessor. Among various communication, processing, and management functions, the electronic controller 26 is configured, i.e., constructed and programmed, to determine remaining useful life of the air filter 20.

To support determination of remaining useful life of the air filter 20, the electronic controller 26 specifically includes a processor and tangible, non-transitory memory, which includes instructions programmed therein for processing data signals and executing commands. The memory may be an appropriate recordable medium that participates in providing computer-readable data or process instructions. Such a recordable medium may take many forms, including but not limited to non-volatile media and volatile media. Non-volatile media for the electronic controller 26 may include, for example, optical or magnetic disks and other persistent memory. Volatile media may include, for example, dynamic random-access memory (DRAM), which may constitute a main memory. The instructions programmed into the electronic controller 26 may be transmitted by one or more transmission medium, including coaxial cables, copper wire and fiber optics, including the wires that comprise a system bus coupled to a processor of a computer, or via a wireless connection.

Memory of the electronic controller 26 may also include a flexible disk, hard disk, magnetic tape, another magnetic medium, a CD-ROM, DVD, another optical medium, etc. The electronic controller 26 may be configured or equipped with other required computer hardware, such as a high-speed clock, requisite Analog-to-Digital (A/D) and/or Digital-to-Analog (D/A) circuitry, input/output circuitry and devices (I/O), as well as appropriate signal conditioning and/or buffer circuitry. Subsystems and algorithm(s), indicated generally via numeral 28, required by the electronic controller 26 or accessible thereby may be stored in the memory of the controller and automatically executed to facilitate operation of the air filter life monitoring system 24. Specifically, subsystems and algorithm(s) 28 may include an inventory mode configured to monitor the induction system 14 and/or interrogate the induction system at predetermined time intervals, as measured via the high-speed clock. As such, the electronic controller 26 includes a non-transitory computer-readable medium having instructions stored thereon that, when executed by one or more processors, cause performance of a set of functions described in detail below.

The electronic controller 26 may be programmed to regulate the speed of the ICE 12 to acquire data for clean and in-service air filter as described in detail below. The electronic controller 26 is specifically programmed to initiate determination of remaining useful life of the air filter 20 by acquiring two distinct sets of data of mass airflow rate in g/sec (via the mass airflow rate sensor 25-1), corresponding air pressure in kPa (via the pressure sensor 25-2), and air temperature in degrees Celsius (via the air temperature sensor 25-3) of the induction system. The electronic controller 26 may be programmed to initiate determination of remaining useful life of the air filter 20 once the vehicle 10 has traversed a predetermined distance to ensure that the vehicle is being subjected to real world operating conditions. The electronic controller 26 is specifically programmed to acquire two distinct sets of data at a steady state condition of the ICE 12. Generally, various approaches and hardware may be used for acquisition of air pressure, temperature, and mass airflow rate data sets, which may then be employed for determining a remaining useful service life of an engine air filter.

The electronic controller 26 specifically includes subsystems and algorithm(s) 28 configured to monitor ICE 12 and vehicle 10 functions, including an engine run mode status 30 indicative of whether the ICE is running or off, engine idle active status 32 indicative of whether the ICE is operating at idle, and a catalyst warm up status 34 indicative of whether exhaust emission system catalyst(s) has achieved a thermal threshold. The electronic controller 26 also includes an elapsed time counter 36 configured to record the total elapsed time the vehicle 10 has been in service. The electronic controller 26 further monitors the vehicle's odometer (not shown), which may be displayed on an instrument panel of the vehicle 10, configured to record the total distance or mileage the subject vehicle has been driven since new.

With reference to FIG. 2, the electronic controller 26 may be additionally programmed to display a message 38 corresponding to an encoded stored record of the % remaining useful life of the in-service air filter 20, on the vehicle's instrument panel. Accordingly, the message 38 is intended to report the % remaining useful life of the in-service air filter 20 to the user of the vehicle 10 or a service technician. The electronic controller 26 may also be programmed to set a sensory signal 40 when the computed pressure drop difference is equal to or greater than a predetermined value 42 (such as in a range of 2.3-2.5 kPa), or when the % remaining useful life of the in-service air filter 20 is equal to or less than a predetermined percentage threshold (such as in a range of 0%-5%). As such, the electronic controller 26 may include a non-transitory computer-readable medium having executable instructions stored thereon and specifically configured to set the sensory signal 40. In either event, the sensory signal 40 is intended to signify that the air filter 20 has become clogged with particulate matter. In other words, the sensory signal 40 is intended to alert the vehicle's user and/or a service technician that the air filter 20 has reached the end of its useful life and replacement of the air filter is recommended.

Figure 4:
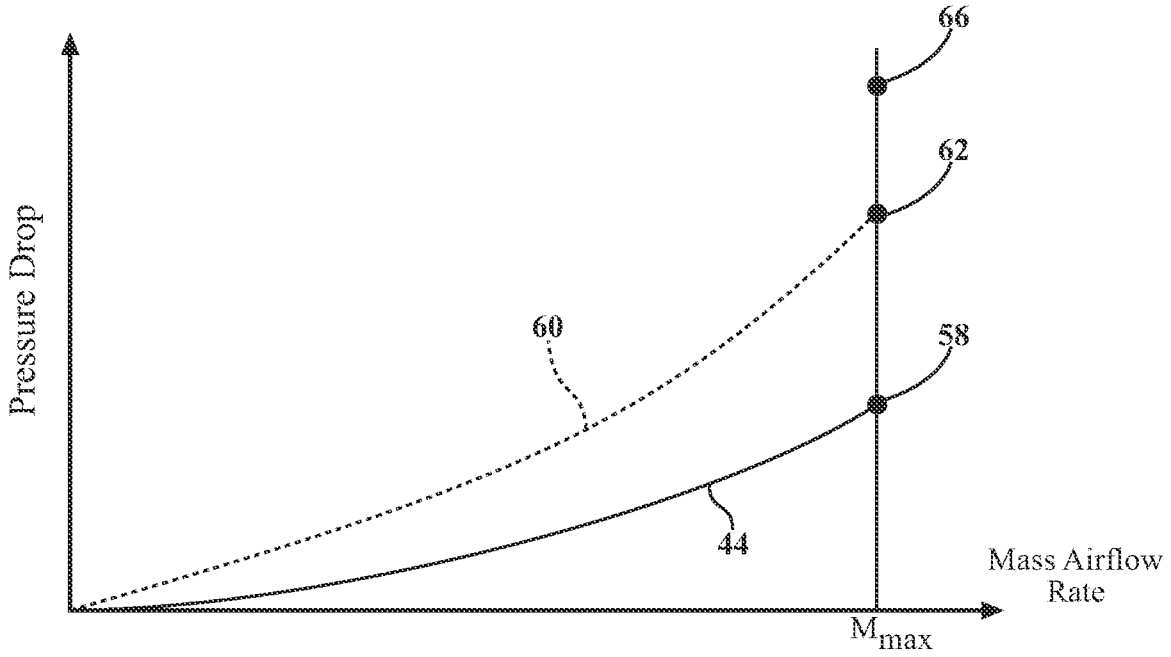
FIG. 4 is a graph of pressure drop versus mass airflow rate, illustrating comparison of the developed clean air filter relationship and the developed in-service air filter relationship during determination of the in-service air filter's remaining useful life corresponding to a computed delta pressure drop, according to the disclosure.

FIGS. 3 and 4 display graphs of pressure drop (from atmospheric pressure to pressure values detected by the pressure sensor 25-2) versus the mass airflow rate detected by the mass airflow rate sensor 25-1 corrected to a reference ambient pressure of 100 kPa and a reference temperature of 20° C. FIGS. 3 and 4 illustrate development and establishment of clean and in-service air filter life relationships of pressure drop versus mass airflow rate as embodied in corresponding curves in two distinct stages—Stage 1 and Stage 2—that will be described in greater detail below. FIG. 3 depicts a clean air filter self-calibration relationship or curve 44 of pressure drop versus mass airflow rate for a given ICE 12 and vehicle 10 configuration. Establishment of the clean air filter self-calibration relationship or curve 44 may start with Stage 1, including establishment of an initial coarse estimate of the clean air filter self-calibration relationship or curve 46 depicted in FIG. 3 as the region bounded by the two curves 46A and 46B.

The initial coarse estimate of the clean air filter self-calibration relationship or curve 46 employs air filter pressure drop data from a warm ICE 12 operating at a low engine speed, such as idle, along with a first clean air filter data set ($P_{1C}$, $M_{1C}$, $T_{1C}$) for an operating condition 48 close to the subject low engine speed condition. So that an atmospheric pressure term may be eliminated in subsequent calculations, the operating condition 48 is specifically established to permit establishment of the initial coarse estimate of the clean air filter self-calibration relationship or curve 46 without direct detection of atmospheric pressure. The operating condition 48 constraint is imposed on the data sets used to construct the initial coarse estimate of the clean air filter self-calibration relationship or curve 46, as one data set is to be representative of an operating condition close to the warm ICE 12 low engine speed (e.g., engine idle) condition, represented by a relatively smaller data range shown in FIG. 3, herein defined as Stage 1. Subsequently, the initial coarse estimate of the clean air filter self-calibration relationship or curve 46 may be used to estimate the atmospheric pressure in combination with a data set having the $M_{1C}$ term beyond the warm ICE 12 low engine speed operating condition, as represented by a relatively larger range shown in FIG. 3, and herein defined as Stage 2. The larger range for $M_{1C}$ in Stage 2 enables an increase in availability of data with larger mass airflow rate values, which in turn may be used to improve accuracy of the estimate of the clean air filter self-calibration relationship or curve 44.

The air filter life monitoring system 24 may initiate the establishment of the clean air filter self-calibration relationship or curve 44 shown in FIG. 3 once a set odometer threshold 50 for the vehicle is met. The air filter life monitoring system 24 sets this threshold 50 to increase the likelihood that the vehicle 10 is in the customers hands during the start of the calibration and not in a pre-delivery stage. For example, the threshold 50 may be set at 100 km, to ensure that the vehicle is being subjected to real world operating conditions. Prior to achieving the set odometer threshold 50, the air filter life monitoring system 24 will report the message 38, in the specific instance indicative of 100% remaining useful life of the in-service air filter 20.

In Stage 1 shown in FIG. 3, a pressure drop from atmospheric pressure to the values detected by the pressure sensor 25-2 at the warm ICE 12 low speed condition is determined. Warm ICE 12 low speed condition may be defined by the engine run mode status 30 being set to run, and each of the engine idle active status 32 and the catalyst warm up status 34 being set to true. When the electronic controller 26 determines that the warm ICE 12 low engine speed condition is satisfied, the mass airflow rate $M_{Engine\ On}$ (detected via the mass airflow rate sensor 25-1), corresponding air pressure $P_{Engine\ On}$ (detected via the pressure sensor 25-2) and air temperature $T_{Engine\ On}$ (detected via the air temperature sensor 25-3) are recorded in the controller memory. The air filter life monitoring system 24 then monitors transitions or changes of the engine run mode status 30. If the engine run mode status 30 transitions from run to off within a calibrated elapsed time threshold detected by the counter 36, the electronic controller 26 records data of air pressure $P_{Engine\ off}$ (detected via the pressure sensor 25-2) and air temperature $T_{Engine\ off}$ (detected via the air temperature sensor 25-3).

The air pressure data at engine off corresponds to the atmospheric pressure at that recorded instant in time. Pressure drop at idle, i.e., at the requisite low engine speed condition, or $P_{Idle\ Bias}$ is specifically defined as follows:

$$P_{Idle\ Bias}=P_{Engine\ Off}-P_{Engine\ On} \tag{1}$$

$$\text{wherein, } M_{Idle\ Bias}=M_{Engine\ On} \tag{2}$$

The computed $P_{Idle\ Bias}$ may be corrected to a reference ambient pressure of 100 kPa and a reference temperature of 20° C. using the following expression:

$$P_{Idle\ Bias\ Corrected}=P_{Idle\ Bias}\left\{\frac{(P_{EngineOff})/100}{(T_{EngineOff}+273.1)/293.1}\right\} \tag{3}$$

The electronic controller 26 repeats the above steps to determine the pressure drop from atmospheric pressure to the pressure value detected by the pressure sensor 25-2 at the subject warm ICE 12 low speed condition an N number of times. The number of times N is a preset, empirically calibrated value, permitting pressure drop and mass airflow rate average values to be determined by the following expressions:

$$P_{Idle\ Bias\ Corrected\ Avg}=\frac{1}{N}\sum_{i=1}^{N}P_{IdleBiasCorrected} \tag{4}$$

$$M_{Idle\ Bias\ Avg}=\frac{1}{N}\sum_{i=1}^{N}M_{Idle\ Bias} \tag{5}$$

As may be seen in FIG. 3, each of the pressure drop versus mass airflow rate relationships or curves 44 and 46 will intersect with the origin, where zero mass airflow rate occurs at zero pressure drop. A corrected warm ICE 12 low speed, e.g., idle, condition ($M_{Idle\ Bias\ Avg}$, $P_{Idle\ Bias\ Corrected\ Avg}$) 52 is also shown in FIG. 3.

The first initial coarse clean air filter self-calibration relationship or curve 46 is established using data sets whereby the first clean air filter data set ($P_{1C}$, $M_{1C}$, $T_{1C}$) for the operating condition 48 (shown in FIG. 3) is acquired at the warm ICE 12 low speed condition with a relatively low mass airflow rate. The second clean air filter data set ($P_{2C}$, $M_{2C}$, $T_{2C}$) for an operating condition 56 is acquired at an elevated ICE 12 speed, i.e., substantially above idle, within a predetermined timeframe $t_1$ of determining the first clean air filter data set. The predetermined timeframe $t_1$ is intended to provide sufficient amount of time to permit a significant change in mass airflow rate and airflow pressure, but without a significant change in ambient conditions. In other words, the predetermined timeframe $t_1$ may be selected to minimize errors that might otherwise result from changing atmospheric pressure due to changes in weather conditions, geographical elevation, or other factors. For example, the predetermined timeframe $t_1$ may, be in a range of 2-8 seconds, to facilitate capturing the largest separation between the lower mass airflow rate $M_{1C}$ and the higher mass airflow rate $M_{2C}$.

As the first clean air filter set ($P_{1C}$, $M_{1C}$, $T_{1C}$) for operating condition 48 is acquired, where $M_{1C}$ is around $M_{Idle\ Bias\ Avg}$ within the narrow band of Stage 1 shown in FIG. 3, the pressure drop, after correcting to a reference ambient pressure of 100 kPa and a reference temperature of 20° C., is approximately:

$$\Delta P_{1C} = (P_{atm} - P_{1C})\left\{\frac{(P_{1C})/100}{(T_{1C}+273.1)/293.1}\right\} \cong P_{Idle\ Bias\ Corrected\ Avg} \tag{6}$$

Also, the pressure drop at the second clean air filter data set ($P_{2C}$, $M_{2C}$, $T_{2C}$) for an operating condition 56 after correcting to a reference ambient pressure of 100 kPa and a reference temperature of 20° C. is given by:

$$\Delta P_{2C} = (P_{atm} - P_{2C})\left\{\frac{(P_{1C})/100}{(T_{1C}+273.1)/293.1}\right\} \tag{7}$$

Equations (6) and (7) are combined to eliminate the $P_{atm}$ term (as noted above), thus resulting in:

$$\Delta P_{2C} = P_{Idle\ Bias\ Corrected\ Avg} + (P_{1C} - P_{2C})\left\{\frac{(P_{1C})/100}{(T_{1C}+273.1)/293.1}\right\} \tag{8}$$

The ($M_{2C}$, $\Delta P_{2C}$) data pair for the operating condition 56 is shown in FIG. 3. The electronic controller 26 is programmed to repeat the process of collecting data sets having one data set with a relatively low mass airflow rate at the warm ICE 12 low speed condition, where $M_{1C}$ is around $M_{Idle\ Bias\ Avg}$ within the narrow band of Stage 1, until a sufficient number of data pairs for the representative operating condition 56 is collected. Thus, collected multiple data pairs for the operating condition 56 are organized and stored in a predetermined number of discrete bins. The electronic controller 26 may then store data pairs by mass airflow rate in the subject bins, wherein each discrete bin stores data pairs over a predefined range of mass airflow rate values.

The electronic controller 26 may be programmed to collect a minimum number of ($M_{2C}$, $\Delta P_{2C}$) data pairs in each discrete bin. The electronic controller 26 may be additionally programmed to continuously average the ($M_{2C}$, $\Delta P_{2C}$) data pairs in each respective bin as follows:

$$M_{C\ Avg\ i} = \frac{1}{m}\sum_{j=1}^{m} M_{2Cij} \tag{9}$$

$$\Delta P_{C\ Avg\ i} = \frac{1}{m}\sum_{j=1}^{m} \Delta P_{2Cij} \tag{10}$$

In the relationships (9) and (10) above, factor i represents the $i^{th}$ bin and factor j represents the $j^{th}$ data pair in the $i^{th}$ bin. The number of bins is not restricted, i.e., as many or as few bins may be employed to map the desired number of discrete ($M_{2C}$, $\Delta P_{2C}$) data pairs. Once the subject bins have sufficient data, an initial quadratic curve may be fit to the data ($M_{C\ Avg\ i}$, $\Delta P_{C\ Avg\ i}$) to establish the initial coarse clean air filter self-calibration relationship or curve 46 having a zero intercept as follows:

$$\Delta P_{C\ Coarse} = c_1 M + c_2 M^2 \tag{11}$$

The coefficients $c_1$ and $c_2$ in equation (11) represent a regression best fit of the clean air filter data collected during Stage 1.

In Stage 2, the electronic controller 26 may use equation (11), the initial coarse estimate of the clean air filter self-calibration relationship or curve 46 to estimate the atmospheric pressure in combination with a first clean air filter data set ($P_{1C}$, $M_{1C}$, $T_{1C}$) for the operating condition 48, where the $M_{1C}$ term is within the larger Stage 2, as shown in FIG. 3. The electronic controller 26 may acquire a second clean air filter data set ($P_{2C}$, $M_{2C}$, $T_{2C}$) for an operating condition 56 at an elevated ICE 12 speed, within a predetermined timeframe $t_1$ of determining the first clean air filter data set. The electronic controller 26 may determine the pressure drop at the second clean air filter data set ($P_{2C}$, $M_{2C}$, $T_{2C}$) for the operating condition 56 including a correction to a reference ambient pressure of 100 kPa and a reference temperature of 20° C. as follows:

$$\Delta P_{2C} = c_1 M_{1C} + c_2 M_{1C}^2 + (P_{1C} - P_{2C})\left\{\frac{(P_{1C})/100}{(T_{1C}+273.1)/293.1}\right\} \tag{12}$$

The data pair ($M_{2C}$, $\Delta P_{2C}$) for the operating condition 56 is shown in FIG. 3. The electronic controller 26 may repeat the process of collecting data sets in Stage 2, grouping and averaging the data in discrete predetermined bins as in the above-described with respect to Stage 1. Following the above, the electronic controller 26 may establish a final clean air filter relationship or curve 44 based on a quadratic regression fit of the data from Stage 2 according to the following equation:

$$\Delta P_{C\ Final} = d_1 M + d_2 M^2 \tag{13}$$

The coefficients $d_1$ and $d_2$ in the expression (13) represent a regression best fit of the clean air filter data in Stage 2. The electronic controller 26 may then compute an extrapolated maximum clean air filter pressure drop $\Delta P_{C\ max}$ 58 at a preset maximum mass airflow rate $M_{max}$ as follows:

$$\Delta P_{C\ max} = d_1 M_{max} + d_2 M_{max}^2 \tag{14}$$

The preset maximum mass airflow rate $M_{max}$ may be established empirically, for example, for a particular ICE 12 operating at peak performance (e.g., 200 gm/sec).

Following the establishment of clean air filter relationship or curve 44, once the air filter 20 is in-service, the electronic controller 26 may initiate monitoring of the subject air filter and construction of an in-service air filter relationship or curve 60 (shown in FIG. 4). The monitoring of the in-service air filter 20 and construction of the in-service air filter relationship or curve 60 may commence in the same manner as the construction of the clean air filter relationship or curve 44. In other words, the in-service air filter relationship or curve 60 may be constructed using the two-stage process, starting with a determination of the pressure drop with a warm ICE 12 at low engine speed, e.g., idle, followed by the Stage 1 initial coarse in-service air filter curve determination.

Analogous to the clean curve development, when the respective bins have sufficient data, an initial quadratic curve may be fit to the data ($M_{In\text{-}Service\ Avg\ i}$, $\Delta P_{In\text{-}Service\ Avg\ i}$) to establish the initial coarse in-service air filter self-calibration curve (analogous to the clean filter self-calibration relationship or curve 46) having a zero intercept as follows:

$$\Delta P_{In\text{-}Service\ Coarse}=e_1M+e_2M^2 \tag{15}$$

The coefficients $e_1$ and $e_2$ in equation (15) represent a regression best fit of the in-service air filter data collected during Stage 1. Then a final in-service air filter relationship or curve ($\Delta P_{In\text{-}Service\ Final}$) 60 determination during Stage 2 is given by:

$$\Delta P_{In\text{-}Service\ Final}=f_1M+f_2M^2 \tag{16}$$

The coefficients $f_1$ and $f_2$ in equation (16) represent a regression best fit of the Stage 2 in-service air filter data. The electronic controller 26 may further compute an extrapolated in-service air filter pressure drop ($\Delta P_{In\text{-}Service\ max}$) 62 at the maximum mass airflow rate $M_{max}$ as follows:

$$\Delta P_{In\text{-}Service\ max}=f_1M_{max}+f_2M_{max}^2 \tag{17}$$

With reference to FIG. 4, the electronic controller 26 is further programmed to compare the $\Delta P_{C\ max}$ 58, the $\Delta P_{In\text{-}Service\ max}$ 62 with a predetermined pressure drop limit value $\Delta P_{Dirty}$ 64 at $M_{max}$, shown in FIG. 2. The value $\Delta P_{Dirty}$ 64 is intended to signify that the air filter 20 has become clogged with particulate matter and is at end of its useful life. For example, the value $\Delta P_{Dirty}$ 64 may be set at 2.5 kPa. A pressure drop 66 at maximum mass airflow rate $M_{max}$ for an end of life air filter is shown in FIG. 4 and is equal to the sum of $\Delta P_{C\ max}$ 58 and the value $\Delta P_{Dirty}$ 64. The electronic controller 26 computes and stores the proportion or % remaining useful life of the in-service air filter (RULISAF), as follows:

$$\%\ RULISAF = 100\{^{\Delta P_{Cmax}+\Delta P_{Dirty}-\Delta P_{In\text{-}Service\ max}}/\Delta P_{Dirty}\} \tag{18}$$

In other words, the electronic controller 26 may be programmed to determine the remaining useful life of the in-service air filter 20 as a percentage of the maximum life of the clean air filter based on the computed ΔP.

Figure 5:
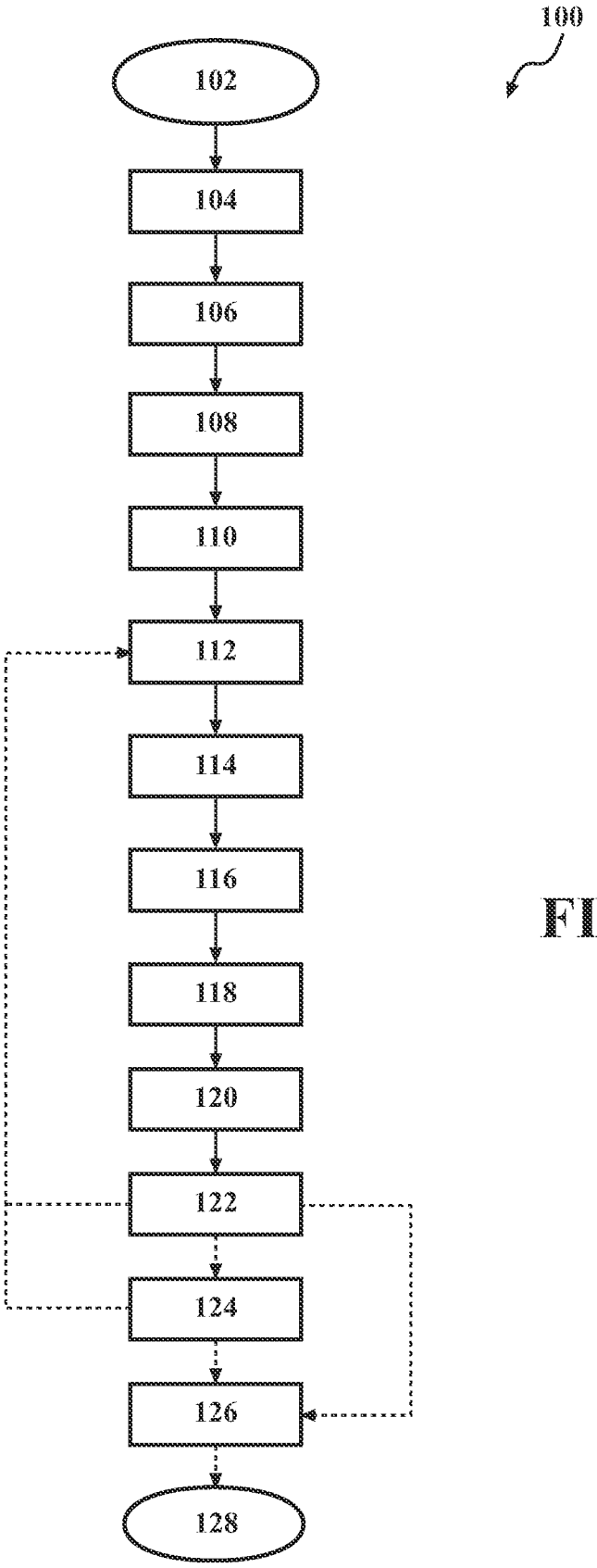
FIG. 5 illustrates a method of self-calibration of an ICE air filter life monitoring system shown in FIGS. 1-4 and determination of an in-service air filter's remaining useful life.

A method 100 of self-calibration of the air filter life monitoring system 24 for an internal combustion engine (ICE) is shown in FIG. 5 and described below with reference to FIGS. 1-4. According to the method, the electronic controller 26 may be programmed to regulate the speed of the ICE 12 to acquire the pertinent clean and in-service air filter data sets as described with respect to FIGS. 1-4, and in further detail below. Method 100 commences in frame 102. The method may initiate determination of remaining useful life of the air filter 20 with verifying, via the electronic controller 26 in communication with the vehicle's odometer, that the set predetermined traversed distance threshold 50 has been met. Additionally, in frame 102 the method may include determining the mass airflow, the air pressure, and the air temperature, via the electronic controller 26 in communication with the respective mass airflow rate sensor 25-1, the pressure sensor 25-2, and the air temperature sensor 25-3.

Following frame 102 the method advances to frame 104, to initiate construction of the clean air filter relationship or curve 44. In frame 104 the method includes acquiring, at a low ICE 12 speed, such as idle, the first clean air filter data set defined by a first clean air filter pressure ($P_{1C}$), the first clean air filter mass airflow rate ($M_{1C}$), and the first clean air filter temperature ($T_{1C}$). The subject acquisition of the first clean air filter data set is performed via the electronic controller 26 regulating and interrogating the pressure sensor 25-2, the mass airflow rate sensor 25-1, and the air temperature sensor 25-3. From frame 104 the method moves on to frame 106, where the method includes acquiring, via the electronic controller 26 regulating and interrogating the respective pressure, mass airflow rate, and air temperature sensors, at an elevated ICE speed, the second clean air filter data set defined by the second clean air filter pressure ($P_{2C}$), the second clean air filter mass airflow rate ($M_{2C}$), and the second clean air filter temperature ($T_{2C}$). After frame 106 the method proceeds to frame 108. In frame 108, the method includes establishing, via the electronic controller 26, the clean air filter pressure drop vs. mass airflow rate relationship using the acquired clean air filter first and second data sets.

In frame 108 the method may also include determining, via the electronic controller 26, the atmospheric air pressure downstream of the clean air filter with the ICE 12 off and determining the clean air filter pressure at the low ICE 12 speed. In frame 108 the method may additionally include determining the clean air filter pressure drop. As noted above with respect to FIGS. 1-4, the clean air filter pressure drop values may be corrected to the reference ambient pressure of 100 kPa and reference temperature of 20° C. Determining the clean air filter pressure drop may specifically include determining the average clean air filter pressure drop value ($P_{Idle\ Bias\ Corrected\ Avg}$) via computing the average difference between the determined atmospheric air pressure downstream of the clean air filter with the ICE 12 off and the determined clean air filter pressure at the low ICE speed, as described above with respect to the mathematical expressions (1) through (5). Furthermore, in frame 108, establishing the clean air filter relationship may include using the determined clean air filter pressure drop ($P_{Idle\ Bias\ Corrected\ Avg}$) at the first clean air filter mass airflow rate ($M_{1C}$).

As described above with respect to FIGS. 1-4, establishing the clean air filter relationship may be accomplished in two stages, Stage 1 and Stage 2. Specifically, establishing the clean air filter relationship may include establishing the coarse clean air filter relationship in Stage 1 using the acquired clean air filter first and second data sets and the clean air filter pressure drop ($P_{Idle\ Bias\ Corrected\ Avg}$) to estimate the second clean air filter pressure drop ($\Delta P_{2C}$) corrected to the reference ambient pressure of 100 kPa and reference temperature of 20° C. at the second clean air filter mass airflow rate ($M_{2C}$). Establishing the clean air filter relationship may include generating the first quadratic equation to fit the second clean air filter pressure drop ($\Delta P_{2C}$) and the second clean air filter mass airflow rate ($M_{2C}$) with the coarse clean air filter relationship. Establishing the clean air filter relationship may also include establishing the final clean air filter relationship in Stage 2 using new first and second clean air filter data sets and the first quadratic equation to estimate final second clean air filter pressure drop ($\Delta P_{2C}$) corrected to the reference ambient pressure of 100 kPa and reference temperature of 20° C. at the final second clean air filter mass airflow rate ($M_{2C}$). Additionally, establishing the clean air filter relationship may include generating the second quadratic equation to fit the new second clean air filter pressure drop ($\Delta P_{2C}$) and the second clean air filter mass airflow rate ($M_{2C}$) with the final clean air filter relationship.

As described above with respect to FIGS. 1-4, establishing the coarse and the final clean air filter relationships may include collecting multiple data pairs ($M_{2C}$, $\Delta P_{2C}$) to additionally refine the estimated clean air filter pressure drop vs. mass airflow rate relationship. The method may also include organizing the collected multiple data pairs ($M_{2C}$, $\Delta P_{2C}$) in a predetermined number of bins and averaging the ($M_{2C}$, $\Delta P_{2C}$) data pairs in each respective bin. And furthermore, the method may include using the averaged ($M_{C\ Avg\ i}$, $\Delta P_{C\ Avg\ i}$) data pairs of the clean air filter for each $i^{th}$ bin based on equations (9) and (10) to generate each of the first quadratic equation (11) for the coarse clean air filter relationship and the second quadratic equation (13) for the final clean air filter relationship. According to the method, as referenced above in the expression (12), determining the pressure drop at the second clean air filter data set ($P_{2C}$, $M_{2C}$, $T_{2C}$) for the operating condition 56 may include the correction to the reference ambient pressure of 100 kPa and reference temperature of 20° C. As described above with respect to FIGS. 1-4, generating the second quadratic equation may include determining polynomial coefficients $c_1$ and $c_2$ of the second quadratic equation (11), as well as determining the maximum clean air filter pressure drop ($\Delta P_{C\ max}$) with the clean air filter includes using the final clean air filter relationship (13).

Following frame 108 the method proceeds to frame 110. In frame 110 the method includes determining, via the electronic controller 26, the maximum clean air filter pressure drop ($\Delta P_{C\ max}$) at the preset maximum mass airflow rate ($M_{max}$) with the clean air filter using the final clean air filter relationship (13). Determination of the maximum clean air filter pressure drop ($\Delta P_{C\ max}$) is described above with respect to FIGS. 1-4 and represented by the mathematical relationship (14). After frame 110, i.e., following the establishment of the clean air filter relationship or curve 44, and once the air filter 20 has been put into service, the method advances to frame 112, to initiate monitoring the subject in-service air filter. Starting with frame 112, the method employs the electronic controller 26 to construct the in-service air filter relationship or curve 60 analogously to the construction of the clean air filter relationship or curve 44. Frame 112 specifically includes acquiring, via the electronic controller 26, at the low ICE speed, the first in-service air filter data set defined by the first in-service air filter pressure ($P_{1\ In\text{-}Service}$), the first in-service air filter mass airflow rate ($M_{1\ In\text{-}Service}$), and the first in-service air filter temperature ($T_{1\ In\text{-}Service}$). Following frame 112 the method proceeds to frame 114. In frame 114, the method includes acquiring, via the electronic controller 26, at the elevated ICE speed, the second in-service air filter data set defined by the second in-service air filter pressure ($P_{2\ In\text{-}service}$), the second in-service air filter mass airflow rate ($M_{2\ In\text{-}Service}$), and the second in-service air filter temperature ($T_{2\ In\text{-}Service}$). As with the clean air filter data sets, the above acquisition of the first and second in-service air filter data sets is accomplished via the electronic controller 26 regulating and interrogating the respective pressure sensor 25-2, mass airflow rate sensor 25-1, and air temperature sensor 25-3.

After frame 114 the method moves on to frame 116. In frame 116, the method includes establishing, via the electronic controller 26, the in-service air filter pressure drop vs. mass airflow rate relationship using the acquired in-service air filter first and second data sets. In frame 116 the method may also include determining, via the electronic controller 26, the atmospheric air pressure downstream of the in-service air filter with the ICE 12 off. Also in frame 116, the method may additionally include determining, via the electronic controller 26, the in-service air filter pressure at the low ICE speed, e.g., idle. Additionally, in frame 116, the method may include determining, via the electronic controller 26, the in-service air filter pressure drop. As noted above with respect to determination of the clean air filter pressure drop values, the air filter pressure drop values may be corrected to standard temperature and pressure. Determining the in-service air filter pressure drop may specifically include determining the average air filter pressure drop value ($P_{Idle\ Bias\ Corrected\ In\text{-}Service\ Avg}$) via computing the average difference between the determined atmospheric air pressure downstream of the in-service air filter with the ICE 12 off and the determined in-service air filter pressure at the low ICE speed, analogously to the mathematical expressions (1) through (5). Furthermore, in frame 116, establishing the in-service air filter relationship may include using the determined in-service air filter pressure drop ($P_{Idle\ Bias\ Corrected\ In\text{-}Service\ Avg}$) at the first in-service air filter mass airflow rate ($M_{1\ In\text{-}Service}$).

As described above with respect to FIGS. 1-4 relative to the analogous development of the clean air filter relationship, in frame 116 the in-service air filter relationship may be accomplished in two respective stages—Stage 1 and Stage 2. Specifically, establishing the in-service air filter relationship may include establishing the coarse in-service air filter relationship in Stage 1 using the acquired in-service air filter first and second data sets and the in-service air filter pressure drop ($P_{Idle\ Bias\ Corrected\ In\text{-}Service\ Avg}$) to estimate the second in-service air filter pressure drop ($\Delta P_{2\ In\text{-}Service}$) corrected to a reference ambient pressure of 100 kPa and a reference temperature of 20° C. at the second in-service air filter mass airflow rate ($M_{2\ In\text{-}Service}$). In frame 116 the method may also include generating the first quadratic equation to fit the second in-service air filter pressure drop ($\Delta P_{2\ In\text{-}Service}$) and the second in-service air filter mass airflow rate ($M_{2\ In\text{-}Service}$) with the coarse in-service air filter relationship. Additionally, in frame 116, the method may include establishing the final in-service air filter relationship in Stage 2 using new first and second in-service air filter data sets and the first quadratic equation to estimate new second in-service air filter pressure drop ($\Delta P_{2\ In\text{-}Service}$) corrected to a reference ambient pressure of 100 kPa and a reference temperature of 20° C. at the second in-service air filter mass airflow rate ($M_{2\ In\text{-}Service}$). Furthermore, in frame 116 the method may include generating the second quadratic equation to fit the new second in-service air filter pressure drop ($\Delta P_{2\ In\text{-}Service}$) and the second in-service air filter mass airflow rate ($M_{2\ In\text{-}Service}$) with the final in-service air filter relationship.

Establishing the coarse and final in-service air filter relationships in frame 116 may include collecting multiple data pairs ($M_{2\ In\text{-}Service}$, $\Delta P_{2\ In\text{-}Service}$) to additionally refine the estimated in-service air filter pressure drop vs. mass airflow rate relationship. Also, establishing the coarse and final in-service air filter relationships may include organizing the collected multiple data pairs ($M_{2\ In\text{-}Service}$, $\Delta P_{2\ In\text{-}Service}$) in the predetermined number of bins and averaging the ($M_{2\ In\text{-}Service}$, $\Delta P_{2\ In\text{-}Service}$) data pairs in each respective bin. Furthermore, analogously to the corresponding development of clean air filter relationships, establishing the coarse and final in-service air filter relationships may include using the averaged data pairs ($M_{In\text{-}Service\ Avg\ i}$, $\Delta P_{In\text{-}Service\ Avg\ i}$) for each $i^{th}$ bin of the in-service air filter. The preceding averaged data pairs ($M_{In\text{-}Service\ Avg\ i}$, $\Delta P_{In\text{-}Service\ Avg\ i}$) may then be used to generate each of the first quadratic equation (15) for the coarse in-service air filter relationship and the second quadratic equation (16) for the final in-service air filter relationship.

Additionally, according to the method, in frame 116 generating the second quadratic equation may include determining polynomial coefficients of the second quadratic equation. Furthermore, determining the maximum in-service air filter pressure drop ($\Delta P_{In\text{-}Service\ max}$) with the in-service air filter may include using the generated final in-service air filter relationship. As noted above, the preceding description of the establishment of the in-service air filter relationship is analogous to the establishment of the clean air filter relationship described in frame 108 and detailed with respect to FIGS. 1-4. Following frame 116 the method proceeds to frame 118. In frame 118, the method includes determining, via the electronic controller 26, the maximum in-service air filter pressure drop ($\Delta P_{In\text{-}Service\ max}$) at the preset maximum mass airflow rate ($M_{max}$) with the in-service air filter using the in-service air filter relationship.

After frame 118 the method advances to frame 120, where the method includes comparing, via the electronic controller 26, the maximum in-service air filter pressure drop ($\Delta P_{In\text{-}Service\ max}$) with the maximum clean air filter pressure drop ($\Delta P_{C\ max}$) to compute the in-service vs. clean air filter pressure drop difference at the preset maximum mass airflow rate ($M_{max}$). Following frame 120 the method moves on to frame 122, where the method includes determining, according to the expression (18), and storing, via the electronic controller 26, the % remaining useful life of the in-service air filter (RULISAF) corresponding to the computed pressure drop ΔP difference. After frame 122, the method may proceed to frame 124. In frame 124 the method additionally includes setting a sensory signal, such as displaying, via the electronic controller 26, the message 38 corresponding to an encoded stored record of the remaining useful in-service life of the air filter 20, inside the vehicle 10.

Following either frame 122 or frame 124 the method may advance to frame 126. In frame 126, the method includes setting the sensory signal 40, via the electronic controller 26, when the computed pressure drop ΔP difference is equal to or greater than the predetermined value 42, which may be in the range of 2.3-2.5 kPa. Alternatively, in frame 126, the method may include setting the sensory signal 40 when the % RULISAF determined in the expression (18) is equal to or less than a preset RULISAF value (such as in the range of 0%-5%) programmed into the electronic controller 26. Additionally, the electronic controller 26 may be programmed to regulate operation of the ICE 12, such as the engine's torque output or its maximum permitted speed in response to the computed pressure drop ΔP difference being equal to or greater than the predetermined value 42.

Timely replacement of a clogged air filter is a significant factor in maintaining efficient operation of the ICE 12. Accordingly, as envisioned, the method 100 enables self-calibrating continuous monitoring of the ICE air filter 20, to determine the filter's % remaining useful life, as the filter progresses from a new/clean state to being clogged with particulate matter. As described above with reference to FIGS. 1-4, each of the clean air filter relationship or curve 44 and the in-service air filter relationship or curve 60 may be generated in two stages, including the generation of respective coarse and final curves through curve fitting and computation of the respective polynomial coefficients. The two-stage generation of the clean and in-service air filter curves is intended to facilitate enhanced accuracy in determination of the air filter's remaining useful life. Additionally, the method 100 enables reporting of the subject air filter's determined useful life to an operator of the host vehicle 10 or to a service technician to affect a timely replacement of the air filter 20. Consequently, following either of the frames 122, or 124, the method may loop back to frame 112 for continued monitoring of the air filter 20 via the ICE 12 air filter life monitoring system 24. Alternatively, the method may conclude in frame 128, such as with a verified replacement of the air filter 20 at the end of its useful life.

Overall, the self-calibrating air filter life monitoring system 24 and the method 100 provide an effective determination of an air filter's remaining useful life and when the filter should be replaced based on actual air filter data. Furthermore, the system 24 and the method 100 facilitate determination of the remaining useful life of an air filter without requiring costly calibration testing for each distinct vehicle engine combination.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A method of self-calibration of an internal combustion engine (ICE) air filter life monitoring system having an electronic controller, the method comprising:

acquiring, via regulating and interrogating respective sensors, at a low ICE speed, a first clean air filter data set defined by a first clean air filter pressure, a first clean air filter mass airflow rate, and a first clean air filter temperature;

acquiring, via regulating and interrogating the respective sensors, at an elevated ICE speed, a second clean air filter data set defined by a second clean air filter pressure, a second clean air filter mass airflow rate, and a second clean air filter temperature;

establishing, via the electronic controller, a clean air filter pressure drop vs. mass airflow rate relationship using the acquired clean air filter first and second data sets;

determining a maximum clean air filter pressure drop at a preset maximum mass airflow rate with the clean air filter using the clean air filter relationship;

acquiring, via regulating and interrogating the respective sensors, at the low ICE speed, a first in-service air filter data set defined by a first in-service air filter pressure, a first in-service air filter mass airflow rate, and a first in-service air filter temperature;

acquiring, via regulating and interrogating the respective sensors, at the elevated ICE speed, a second in-service air filter data set defined by a second in-service air filter pressure, a second in-service air filter mass airflow rate, and a second in-service air filter temperature;

establishing, via the electronic controller, an in-service air filter pressure drop vs. mass airflow rate relationship using the acquired in-service air filter first and second data sets;

determining a maximum in-service air filter pressure drop at the preset maximum mass airflow rate with the in-service air filter using the in-service air filter relationship;

comparing, via the electronic controller, the maximum air filter pressure drops for the clean and in-service air filters to compute an in-service vs. clean air filter pressure drop difference at the preset maximum mass airflow rate; and determining and storing, via the electronic controller, the remaining useful life of the in-service air filter corresponding to the computed pressure drop difference.

2. The method of claim 1, further comprising:

determining an atmospheric air pressure downstream of the clean air filter with the ICE off;

determining a clean air filter pressure at the low ICE speed; and determining a clean air filter pressure drop via computing a difference between the determined atmospheric air pressure downstream of the clean air filter with the ICE off and the determined clean air filter pressure at the low ICE speed;

wherein establishing the clean air filter relationship additionally includes using the determined clean air filter pressure drop at the first clean air filter mass airflow rate.

3. The method of claim 2, wherein establishing the clean air filter relationship is accomplished in two stages and includes:

establishing a coarse clean air filter relationship in a first stage using the acquired clean air filter first and second data sets and the clean air filter pressure drop to estimate the second clean air filter pressure drop at the second clean air filter mass airflow rate;

generating a first quadratic equation to fit the second clean air filter pressure drop and the second clean air filter mass airflow rate with the coarse clean air filter relationship;

establishing a final clean air filter relationship in a second stage using new first and second air filter data sets and the first quadratic equation to estimate a final second clean air filter pressure drop at a final second clean air filter mass airflow rate; and generating a second quadratic equation to fit the final second clean air filter pressure drop and the final second clean air filter mass airflow rate with the final clean air filter relationship.

4. The method of claim 3, wherein establishing the coarse and the final clean air filter relationships includes:

collecting multiple data pairs to refine the clean air filter pressure drop vs. mass airflow rate relationship;

organizing the collected multiple data pairs in a predetermined number of bins;

averaging the data pairs in each respective bin; and using the averaged data pairs of the clean air filter to generate each of the first quadratic equation for the coarse clean air filter relationship and the second quadratic equation for the final clean air filter relationship.

5. The method of claim 4, wherein:

generating the second quadratic equation includes determining polynomial coefficients of the second quadratic equation; and determining the maximum air filter pressure drop with the clean air filter includes using the final clean air filter relationship.

6. The method of claim 1, further comprising:

determining an atmospheric air pressure downstream of the in-service air filter with the ICE off;

determining an in-service air filter pressure at the low ICE speed; and determining an in-service air filter pressure drop via computing a difference between the determined atmospheric air pressure downstream of the in-service air filter with the ICE off and the determined in-service air filter pressure at the low ICE speed;

wherein establishing the in-service air filter relationship additionally includes using the determined in-service air filter pressure drop at the first in-service air filter mass airflow rate.

7. The method of claim 6, wherein establishing the in-service air filter relationship is accomplished in two stages and includes:

establishing a coarse in-service air filter relationship in a first stage using the acquired in-service air filter first and second data sets and the in-service air filter pressure drop to estimate the second in-service air filter pressure drop at the second in-service air filter mass airflow rate;

generating a first quadratic equation to fit the second in-service air filter pressure drop and the second in-service air filter mass airflow rate with the coarse in-service air filter relationship;

establishing a final in-service air filter relationship in a second stage using new first and second in-service air filter data sets and the first quadratic equation to estimate a new second in-service air filter pressure drop at the second in-service air filter mass airflow rate; and generating a second quadratic equation to fit the new second in-service air filter pressure drop and the second in-service air filter mass airflow rate with the final in-service air filter relationship.

8. The method of claim 7, wherein establishing the coarse and final in-service air filter relationships includes:

collecting multiple data pairs to refine the in-service air filter pressure drop vs. mass airflow rate relationship;

organizing the collected multiple data pairs in a predetermined number of bins;

averaging the data pairs in each respective bin; and using the averaged data pairs of the in-service air filter to generate each of the first quadratic equation for the coarse in-service air filter relationship and the second quadratic equation for the final in-service air filter relationship.

9. The method of claim 8, wherein:

generating the second quadratic equation includes determining polynomial coefficients of the second quadratic equation; and determining the maximum air filter pressure drop with the in-service air filter includes using the final in-service air filter relationship.

10. The method of claim 1, further comprising setting a sensory signal when the computed pressure drop difference is equal to or greater than a predetermined value.

11. A self-calibrating air filter life monitoring system for an internal combustion engine (ICE), comprising:

an air induction system having an air filter in fluid communication with the ICE; and an electronic controller configured to determine remaining useful life of the air filter and programmed to:

acquire, at a low ICE speed, a first clean air filter data set defined by a first clean air filter pressure, a first clean air filter mass airflow rate, and a first clean air filter temperature;

acquire, at an elevated ICE speed, a second clean air filter data set defined by a second clean air filter pressure, a second clean air filter mass airflow rate, and a second clean air filter temperature;

establish a clean air filter pressure drop vs. mass airflow rate relationship using the acquired clean air filter first and second data sets;

determine a maximum clean air filter pressure drop at a preset maximum mass airflow rate with the clean air filter using the clean air filter relationship;

acquire, at the low ICE speed, a first in-service air filter data set defined by a first in-service air filter pressure, a first in-service air filter mass airflow rate, and a first in-service air filter temperature;

acquire, at the elevated ICE speed, a second in-service air filter data set defined by a second in-service air filter pressure, a second in-service air filter mass airflow rate, and a second in-service air filter temperature;

establish an in-service air filter pressure drop vs. mass airflow rate relationship using the acquired in-service air filter first and second data sets;

determine a maximum in-service air filter pressure drop at the preset maximum mass airflow rate with the in-service air filter using the in-service air filter relationship;

compare the maximum air filter pressure drops for the in-service and clean air filters to compute an in-service vs. clean air filter pressure drop difference at the preset maximum mass airflow rate; and determine and store the remaining useful life of the in-service air filter corresponding to the computed pressure drop difference.

12. The self-calibrating air filter life monitoring system of claim 11, wherein the electronic controller is further programmed to:

determine an atmospheric air pressure downstream of the clean air filter with the ICE off;

determine a clean air filter pressure at the low ICE speed;

determine a clean air filter pressure drop via computing a difference between the determined atmospheric air pressure downstream of the clean air filter with the ICE off and the determined clean air filter pressure at the low ICE speed; and establish the clean air filter relationship additionally using the determined clean air filter pressure drop at the first clean air filter mass airflow rate.

13. The self-calibrating air filter life monitoring system of claim 12, wherein the electronic controller is programmed to establish the clean air filter relationship in two stages and is further programmed to:

establish a coarse clean air filter relationship in a first stage using the acquired clean air filter first and second data sets and the clean air filter pressure drop to estimate the second clean air filter pressure drop at the second clean air filter mass airflow rate;

generate a first quadratic equation to fit the second clean air filter pressure drop and the second clean air filter mass airflow rate with the coarse clean air filter relationship;

establish a final clean air filter relationship in a second stage using new first and second air filter data sets and the first quadratic equation to estimate a final second clean air filter pressure drop at a final second clean air filter mass airflow rate; and generate a second quadratic equation to fit the final second clean air filter pressure drop and the final second clean air filter mass airflow rate with the final clean air filter relationship.

14. The self-calibrating air filter life monitoring system of claim 13, wherein to establish the coarse and the final clean air filter relationships the electronic controller is programmed to:

collect multiple data pairs to refine the clean air filter pressure drop vs. mass airflow rate relationship;

organize the collected multiple data pairs in a predetermined number of bins;

average the data pairs in each respective bin; and use the averaged data pairs of the clean air filter to generate each of the first quadratic equation for the coarse clean air filter relationship and the second quadratic equation for the final clean air filter relationship.

15. The self-calibrating air filter life monitoring system of claim 14, wherein the electronic controller is further programmed to:

determine polynomial coefficients of the second quadratic equation to generate the second quadratic equation; and use the final clean air filter relationship to determine the maximum air filter pressure drop with the clean air filter.

16. The self-calibrating air filter life monitoring system of claim 11, wherein the electronic controller is further programmed to:

determine an atmospheric air pressure downstream of the in-service air filter with the ICE off;

determine an in-service air filter pressure at the low ICE speed;

determine an in-service air filter pressure drop via computing a difference between the determined atmospheric air pressure downstream of the in-service air filter with the ICE off and the determined in-service air filter pressure at the low ICE speed; and establish the in-service air filter relationship additionally using the determined in-service air filter pressure drop at the first in-service air filter mass airflow rate.

17. The self-calibrating air filter life monitoring system of claim 16, wherein the electronic controller is programmed to establish the in-service air filter relationship in two stages and is further programmed to:

establish a coarse in-service air filter relationship in a first stage using the acquired in-service air filter first and second data sets and the in-service air filter pressure drop to estimate the second in-service air filter pressure drop at the second in-service air filter mass airflow rate;

generate a first quadratic equation to fit the second in-service air filter pressure drop and the second in-service air filter mass airflow rate with the coarse in-service air filter relationship;

establish a final in-service air filter relationship in a second stage using new first and second in-service air filter data sets and the first quadratic equation to estimate a new second in-service air filter pressure drop at the second in-service air filter mass airflow rate; and generate a second quadratic equation to fit the new second in-service air filter pressure drop and the second in-service air filter mass airflow rate with the final in-service air filter relationship.

18. The self-calibrating air filter life monitoring system of claim 17, wherein to establish the coarse and the final in-service air filter relationships the electronic controller is programmed to:

collect multiple data pairs to refine the in-service air filter pressure drop vs. mass airflow rate relationship;

organize the collected multiple data pairs in a predetermined number of bins;

average the data pairs in each respective bin; and use the averaged data pairs of the in-service air filter to generate each of the first quadratic equation for the coarse in-service air filter relationship and the second quadratic equation for the final in-service air filter relationship.

19. The self-calibrating air filter life monitoring system of claim 18, wherein:

determine polynomial coefficients of the second quadratic equation to generate the second quadratic equation; and use the final clean air filter relationship to determine the maximum air filter pressure drop with the in-service air filter.

20. A non-transitory computer-readable medium having executable instructions stored thereon for self-calibration of an internal combustion engine (ICE) air filter life monitoring system, the executable instructions comprising:

acquiring, via regulating and interrogating respective sensors, at a low ICE speed, a first clean air filter data set defined by a first clean air filter pressure, a first clean air filter mass airflow rate, and a first clean air filter temperature;

acquiring, via regulating and interrogating the respective sensors, at an elevated ICE speed, a second clean air filter data set defined by a second clean air filter pressure, a second clean air filter mass airflow rate, and a second clean air filter temperature;

establishing, via the electronic controller, a clean air filter pressure drop vs. mass airflow rate relationship using the acquired clean air filter first and second data sets;

determining a maximum clean air filter pressure drop at a preset maximum mass airflow rate with the clean air filter using the clean air filter relationship;

acquiring, via regulating and interrogating the respective sensors, at the low ICE speed, a first in-service air filter data set defined by a first in-service air filter pressure, a first in-service air filter mass airflow rate, and a first in-service air filter temperature;

acquiring, via regulating and interrogating the respective sensors, at the elevated ICE speed, a second in-service air filter data set defined by a second in-service air filter pressure, a second in-service air filter mass airflow rate, and a second in-service air filter temperature;

establishing, via the electronic controller, an in-service air filter pressure drop vs. mass airflow rate relationship using the acquired in-service air filter first and second data sets;

determining a maximum in-service air filter pressure drop at the preset maximum mass airflow rate with the in-service air filter using the in-service air filter relationship;

comparing, via the electronic controller, the maximum air filter pressure drops for the clean and in-service air filters to compute an in-service vs. clean air filter pressure drop difference at the preset maximum mass airflow rate;

determining and storing, via the electronic controller, the remaining useful life of the in-service air filter corresponding to the computed pressure drop difference; and setting a sensory signal when the computed pressure drop difference is equal to or greater than a predetermined value.

* * * * *